US011091908B2

(12) United States Patent
Paetow et al.

(10) Patent No.: US 11,091,908 B2
(45) Date of Patent: Aug. 17, 2021

(54) THERMAL AND ACOUSTIC INSULATING AND SEALING MEANS FOR A SAFING SLOT IN A CURTAIN WALL

(71) Applicant: HILTI AKTIENGESELLSCHAFT, Schaan (LI)

(72) Inventors: Mario Paetow, Igling (DE); Christian Foerg, Dillishausen (DE); Sebastian Simon, Buchloe Lindenberg (DE); Manfred Klein, Kaufering (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 0 days.

(21) Appl. No.: 16/080,169

(22) PCT Filed: Apr. 12, 2017

(86) PCT No.: PCT/EP2017/058740
§ 371 (c)(1),
(2) Date: Aug. 27, 2018

(87) PCT Pub. No.: WO2017/178512
PCT Pub. Date: Oct. 19, 2017

(65) Prior Publication Data

US 2019/0063064 A1 Feb. 28, 2019

(30) Foreign Application Priority Data

Apr. 13, 2016 (EP) ..... 16165051

(51) Int. Cl.
*E04B 2/88* (2006.01)
*E04B 1/94* (2006.01)
*E04B 5/43* (2006.01)

(52) U.S. Cl.
CPC ..... *E04B 2/88* (2013.01); *E04B 1/948* (2013.01); *E04B 5/43* (2013.01); *E04B 1/942* (2013.01)

(58) Field of Classification Search
CPC ... E04B 2/88; E04B 5/43; E04B 1/948; E04B 1/942
(Continued)

(56) References Cited

U.S. PATENT DOCUMENTS 3,786,604 A * 1/1974 Kramer ..... E04B 1/6801 52/232
4,449,341 A * 5/1984 Taglianetti ..... E04B 2/88 52/235
(Continued)

FOREIGN PATENT DOCUMENTS

FR 1253371 A * 2/1961 ..... E04F 19/045
GB 2 503 465 1/2014
(Continued)

OTHER PUBLICATIONS

International Search Report mated in PCT/EP2017/058740 dated Jul. 4, 2017.
(Continued)

*Primary Examiner* — Brian D Mattei
*Assistant Examiner* — Joseph J. Sadlon
(74) *Attorney, Agent, or Firm* — Grüneberg and Myers, PLLC

(57) ABSTRACT

A thermal insulating and sealant element can thermally insulate and seal a safing slot within a building construction having a wall construction. The insulating and sealant element includes an elastic sealing element; a formwork; an insulator, which comprises a thermally resistant and/or air
(Continued)

tight material; and a supplemental attachment apparatus for attaching the elastic sealing element to an interior wall surface of an interior panel.

19 Claims, 6 Drawing Sheets

(58) Field of Classification Search
USPC ..... 52/235
See application file for complete search history.

(56) References Cited

U.S. PATENT DOCUMENTS 4,506,482 A * 3/1985 Pracht ..... E06B 3/5427 52/235
4,720,948 A * 1/1988 Henley ..... E04B 1/74 52/404.3
4,738,065 A * 4/1988 Crandell ..... E06B 3/5427 52/235
4,982,542 A * 1/1991 Funaki ..... E04B 2/96 52/489.1
5,502,937 A * 4/1996 Wilson ..... B32B 15/14 52/273
5,673,529 A * 10/1997 Treister ..... E04C 2/288 52/235
5,934,036 A * 8/1999 Gallagher, Jr. ..... E04B 5/43 249/188
6,138,419 A * 10/2000 Sekiguchi ..... B21J 15/02 52/235
6,427,405 B1 * 8/2002 Moriya ..... E04F 13/0889 52/396.04
6,523,315 B2 * 2/2003 Ford ..... E04B 1/24
6,532,708 B1 * 3/2003 Baerveldt ..... E01D 19/06 404/47
6,862,852 B1 * 3/2005 Beele ..... A62C 2/065 137/67
7,096,629 B1 * 8/2006 Cox ..... E04F 13/0814 52/235
8,341,908 B1 * 1/2013 Hensley ..... E04B 1/6812 52/396.01
8,365,484 B2 * 2/2013 Foley ..... E04B 1/4114 52/289
8,621,798 B2 * 1/2014 Dayton ..... B32B 3/12 52/289
8,683,763 B2 * 4/2014 Shriver ..... E04B 2/96 52/235
8,728,608 B2 * 5/2014 Maisch ..... E04B 2/82 428/139
8,782,977 B2 * 7/2014 Burgess ..... E04B 2/00 52/235
8,935,897 B2 * 1/2015 Shaw ..... E04B 1/948 52/396.04
8,959,855 B2 * 2/2015 Evensen ..... E04B 2/90 52/236.9
8,997,422 B1 * 4/2015 Kim ..... E04C 3/34 52/439
9,109,352 B1 * 8/2015 Knudson ..... E04B 1/24
9,260,864 B2 * 2/2016 Cole ..... B32B 3/085
9,476,202 B2 * 10/2016 Clancy ..... B32B 7/12
9,499,974 B2 * 11/2016 Bombino ..... E04B 1/40
9,617,729 B2 * 4/2017 Sagnard ..... B32B 15/046
9,708,812 B2 * 7/2017 Jeske ..... E04B 2/96
9,869,086 B2 * 1/2018 Andresen ..... E04B 2/90
10,220,226 B2 * 3/2019 Foerg ..... E04B 1/948
2010/0107532 A1 5/2010 Shriver
2010/0167008 A1 * 7/2010 Maisch ..... E04B 2/789 428/139
2013/0097948 A1 4/2013 Burgess
2018/0030724 A1 * 2/2018 Schulz-Hanke et al. ..... E04B 1/74 52/404.3

FOREIGN PATENT DOCUMENTS

GB 2503465 A * 1/2014
WO 96/26332 8/1996
WO WO-2012119479 A1 * 9/2012 ..... E04B 1/7633

OTHER PUBLICATIONS

Written Opinion of the International Searching Authority mailed in PCT/EP2017/058740 dated Jul. 4, 2017.

* cited by examiner

THERMAL AND ACOUSTIC INSULATING AND SEALING MEANS FOR A SAFING SLOT IN A CURTAIN WALL

This application is a National Stage entry under § 371 of International Application No. PCT/EP2017/058740, filed on Apr. 12, 2017, and claims priority to European Patent Application No. 16165051.0, filed on Apr. 13, 2016.

FIELD OF THE INVENTION

The present invention relates to the field of constructions and systems designed to thermally and acoustically insulate and seal a safing slot area defined between a curtain wall and the individual floors of a building. In particular, the present invention relates to a thermal insulating and sealing means for use with curtain wall structures which include an interior panel such as a back pan or other similar construction which can be of metal or other material extending across the interior surface of a curtain wall which is common in modular designs. The thermal insulating and sealing means is also suitable for acoustically insulating and sealing of a safing slot of a curtain wall structure. The interior panels of a curtain wall are generally made from a metal or insulation material which can easily bend, distort or be otherwise deformed when exposed to strong winds or elevated temperatures, such as intensive sunlight or heat, such as in the event of a fire. Bending, distorting or deforming of these interior panels can result in significant problems in attempting to maintain a complete thermal insulation and seal within the safing slots between the outer edges of the floor construction and the exterior curtain wall construction during a storm or fire. In particular, maintaining of a complete thermal insulation and seal at all time during a fire is important to prevent heat, smoke and flames from spreading from one floor to an adjacent floor.

BACKGROUND OF THE INVENTION

Curtain walls are general used and applied in modern building constructions and are the outer covering of said constructions in which the outer walls are non-structural, but merely keep the weather out and the occupants in. Curtain walls are usually made of a lightweight material, reducing construction costs. The wall transfers horizontal wind loads that are incident upon it to the main building structure through connections at floors or columns of the building. Curtain walls are designed to resist air and water infiltration, sway induced by wind and seismic forces acting on the building, and its own dead load weight forces. Curtain walls differ from store-front systems in that they are designed to span multiple floors, and take into consideration design requirements such as thermal expansion and contraction, building sway and movement, water diversion, and thermal efficiency for cost-effective heating, cooling, and lighting in the building.

A curtain wall structure is defined by an interior wall surface, which includes an interior panel, such as a back pan, extending over the interior surface thereof and at least one floor spatially disposed from the inner wall surface. The gap between the floor and the back pan of a curtain wall defines a safing slot, also referred to as perimeter slab edge, extending between the interior wall surface of the interior panel and the outer edge of the floor. This safing slot is essential to slow the passage of fire and combustion gases between floors. Moreover, the safing slot is needed to compensate dimensional tolerances of the concreted floor and to allow movement between the floor and the façade element caused by load, temperature or wind load.

Therefore, it is of great importance to improve firestopping at the safing slot in order to keep heat, smoke and flames from spreading from one floor to an adjacent floor. It is important to note that the firestop at the perimeter slab edge is considered a continuation of the fire-resistance rating of the floor slab. The curtain wall itself, however, is not ordinarily required to have a rating. It is also of great importance to improve acoustic insulation at the safing slot in order to prevent noise and sound spreading from one floor to an adjacent floor.

Various designs have been known for curtain wall constructions and for means for thermally and/or acoustically insulating and sealing the safing slot. A typical curtain wall configuration comprises a profiled framework of vertical studs, so called mullions, and horizontal studs, so called transoms. The space between these profiles is either filled with glass panels within the window area or spandrel panels within the front of the floors. A common spandrel design comprises a pre-manufactured metal pan filled with insulating material. The remaining gap between spandrel and floor has to be sealed against noise, sound, fire, smoke and sound and withstand certain movement.

Current solutions provide sealing using pre-compressed mineral wool covered by an elastic coating. These solutions have several drawbacks, such as that the installation of a highly pre-compressed mineral wool is labor intensive and not failure proof. Often the pre-compression of the mineral wool is insufficient and can lead to failures in case of movement and fire in addition to the fact that most of the flexible mineral wool is needed to close a static gap. Another disadvantage is that the installed mineral wool cannot be loaded and hence requires additional design measures, such for example attachment of a cover plate. Further, additional and expensive equipment is needed to install the essential fire-stop spray coating. Often the installation process is weather dependent, the mineral wool can absorb water and the coating needs a certain drying time.

Therefore, there is a need for systems that overcome the disadvantages of the prior art systems, in particular, there is a need for systems that can be easily installed within a safing slot, where, for example, access is only needed from one side, implementing a one-sided application. Further, there is a need for systems that are not limited to the width of a joint of a curtain wall structure thereby compensating at the same time dimensional tolerances of the concreted floor and allowing movement between the floor and the façade element caused by load, temperature or wind load. Additionally, maintaining safing insulation between the floors of a residential or commercial building and the exterior curtain wall responsive to various conditions including fire exposure should be guaranteed.

In view of the above, it is an object of the present invention to provide a thermal insulating and sealing means for thermally insulation and sealing of a safing slot in a building containing a curtain wall structure. In particular, it is an object of the present invention to provide a thermal insulating and sealing means which can be easily installed from one side, which maintains the safing insulation between the floors of a residential or commercial building and the exterior curtain wall responsive to various conditions, including fire exposure, and to maximize safing insulation at a minimal cost. Moreover, it is an object to provide a thermal insulating and sealing means which has no limitation of vertical movement capacities, limitation to spandrel height as well as the ability to compensate dimensional tolerances of the concreted floor and to allow movement between the floor and the façade element caused by load, temperature or wind load.

Further, it is an object of the present invention to provide a spandrel panel for use in a fire-resistance rated curtain wall construction, which can be installed on site and hence is part of a modular or prefabricated curtain wall design.

Still further, it is an object of the present invention to provide a building construction comprising such a thermal insulating and sealing means for effectively thermally insulating and sealing of the safing slot between a curtain wall structure and the edge of a floor.

Still further, it is an object to provide at the same time an acoustic insulating and sealing means for effectively acoustically insulating and sealing of the safing slot between a curtain wall structure and the edge of a floor.

These and other objectives as they will become apparent from the ensuring description of the invention are solved by the present invention as described in the independent claims. The dependent claims pertain to preferred embodiments.

SUMMARY OF THE INVENTION

In one aspect, the present invention provides a thermal insulating and sealing means for effectively thermally insulating and sealing of a safing slot within a building construction having a wall construction defining an interior wall surface, which includes an interior panel extending over the interior surface thereof and at least one floor spatially disposed from the inner wall surface defining the safing slot extending between the interior wall surface of the interior panel and an outer edge of the floor, comprising an elastic sealing element positioned in the safing slot and in abutment with respect to the interior wall surface of the interior panel; a formwork positioned in abutment with respect to the elastic sealing element and extending across the safing slot toward the edge of the floor; an insulation means of thermally resistant and/or air tight material in abutment with respect to an upper surface of the formwork and extending across the safing slot toward the outer edge of the floor thereadjacent; and a supplemental attachment means for attaching of the elastic sealing element with respect to the interior wall surface of the interior panel.

In another aspect, the present invention provides a spandrel panel for use in a fire-resistance rated curtain wall construction comprising an elastic sealing element, which comprises a flexible material to facilitate movement between the interior wall surface and the floor; and a formwork positioned in abutment with respect to the elastic sealing element for receiving an insulation means of thermally resistant and/or air tight material for sealing of the safing slot.

In yet another aspect, the present invention provides a building construction comprising said thermal insulating and sealing means.

In yet another aspect, the present invention provides a thermal insulating and sealing means which is suitable for acoustically insulating and sealing of a safing slot of a curtain wall structure.

BRIEF DESCRIPTION OF THE FIGURES

The subject matter of the present invention is further described in more detail by reference to the following figures.

DETAILED DESCRIPTION OF THE INVENTION

Figure 1:
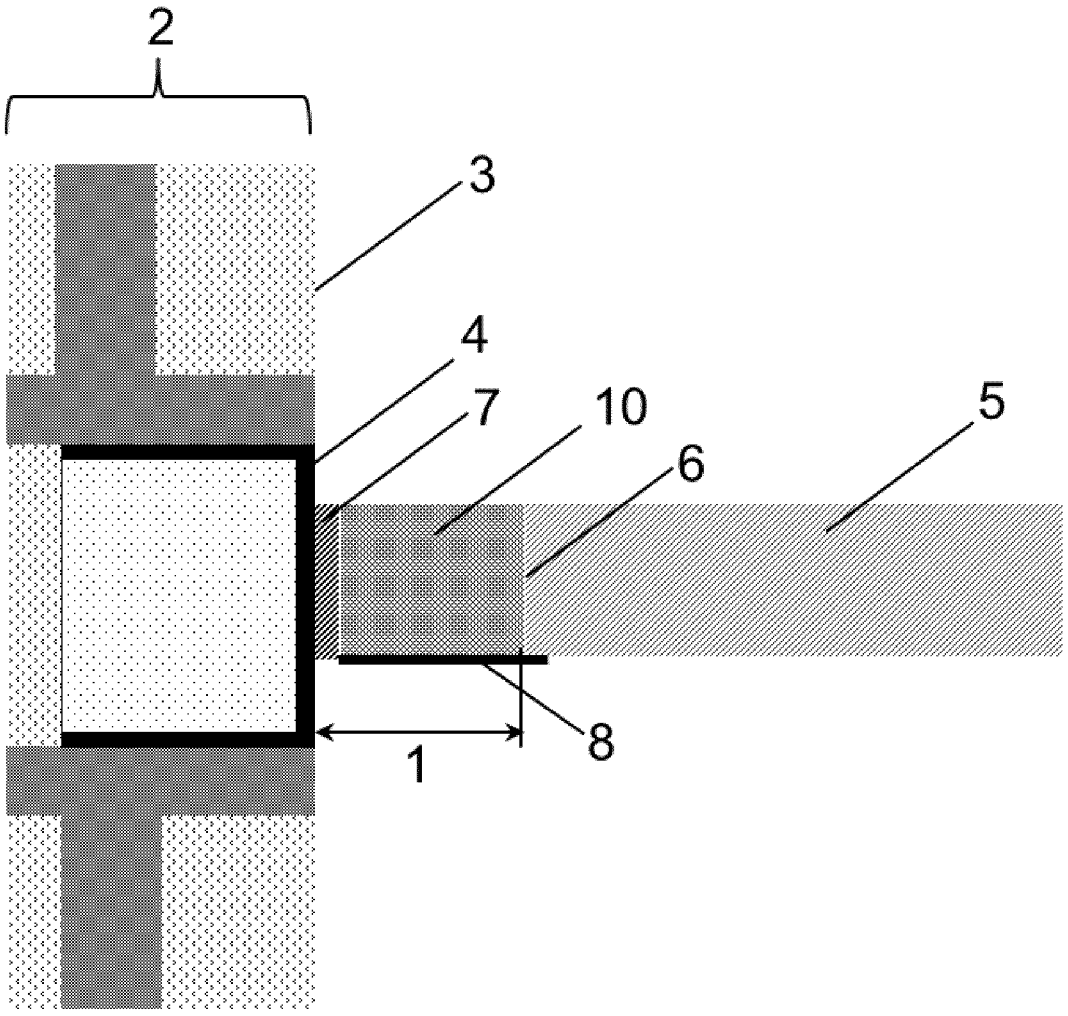
FIG. 1 shows a side cross-sectional view of an embodiment of the thermal/acoustic insulating and sealing means between the outer edge of a floor and the interior wall surface of the interior panel when installed and attached to a steel back pan.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" in context with the present invention refers to a wall structure which is defined by an interior wall surface, including an interior panel, such as a back pan, extending over the interior surface thereof and at least one floor spatially disposed from the inner wall surface.

The term "safing slot" in context with the present invention refers to the gap between a floor and a back pan of a curtain wall; it is also referred to as "perimeter slab edge", extending between the interior wall surface of the interior panel, i. e. back pan, and the outer edge of the floor.

The term "interior panel" in context with the present invention refers, in particular, to a back pan, preferably a steel back pan—also referred to as spandrel panel.

The term "semi-rigid material" in context with the present invention refers to a material, that on one hand is suitable, i.e. soft, to be bend within the safing slot for receiving the insulation means of thermally resistant and/or air tight material; and on the other hand is suitable, i.e. strong/rigid, to enable load.

The present invention pertains to a thermal insulating and sealing means for effectively thermally insulating and sealing of a safing slot within a building construction having a wall construction defining an interior wall surface, which includes an interior panel extending over the interior surface thereof and at least one floor spatially disposed from the inner wall surface defining the safing slot extending between the interior wall surface of the interior panel and an outer edge of the floor. In particular, the present invention pertains to a thermal insulating and sealing means for a curtain wall structure. The curtain wall back pan safing insulation means of the present invention is considered for the purpose of facilitating firestopping of as well as movement within a safing slot present in those buildings utilizing curtain wall structures for the exterior cladding thereof which includes interior panels, such as back pans, which are often made of materials that can deform responsive to exposure to heat.

A curtain wall structure is a type of exterior wall system commonly utilized on buildings wherein the curtain wall itself is a non-bearing wall. Such curtain walls generally are of a relatively lightweight material and commonly include brass or metal skins. This type of construction is normally used in high-rise buildings for providing a relatively lightweight and inexpensive overall construction.

Spandrel panels are included in the curtain wall structure to provide the exterior facing thereof and such panels are commonly made of glass, aluminum, thin sheets of foam material and the like. One particular type of unitized wall structure which is often used in modular constructions includes an interior panel comprising a metallic sheet extending across the internal membrane and this metal sheet is referred to as the back pan. Such curtain wall systems commonly include vertical framing members comprising boxed aluminum channels referred to as mullions and similarly configured horizontally extending pieces as referred to as transoms. Such a transom located or transom configuration at floor level is also known as zero spandrel, i.e., bottom of the transom at the level as top of the concrete floor. The interior panels of curtain wall structures can be made of many materials and many of these materials are susceptible to distorting responsive to high heat conditions. Some of these panels are of made from metallic materials but other non-metallic materials can also be used for this interior panel which are also capable of distorting such as insulation and aluminum clad insulation and many other materials. The thermal insulating and sealing means according to the present invention is applicable for all types of curtain wall structures. The thermal insulating and sealing means according to the present invention is also suitable for acoustically insulating and sealing of a safing slot of a curtain wall structure.

The thermal insulating and sealing means for effectively thermally insulating and sealing of a safing slot within a building construction according to the present invention comprises:

i) an elastic sealing element positioned in the safing slot and in abutment with respect to the interior wall surface of the interior panel;
ii) a formwork positioned in abutment with respect to the elastic sealing element and extending across the safing slot toward the edge of the floor;
iii) an insulation means of thermally resistant and/or air tight material in abutment with respect to an upper surface of the formwork and extending across the safing slot toward the outer edge of the floor thereadjacent;
and
iv) a supplemental attachment means for attaching of the elastic sealing element with respect to the interior wall surface of the interior panel.

In particular, the elastic sealing element according to the present invention comprises a flexible material to facilitate movement between the interior wall surface and the floor. The elastic sealing element is responsive to thermal deforming movement of the interior panel. Preferably, the flexible material comprises a thermally resistant and/or air tight flexible mineral wool material, rubber-like material or a foam, such for example an elastomeric interlaced foam based on synthetic rubber (Armaflex). In particular, the flexible material may be an open-cell or closed-cell foam-based material, for example a polyurethane-based or silicone-based material. In a particular preferred embodiment of the present invention, the elastic sealing element is a polyurethane-based foam, which can also be intumescent if desired.

The elastic sealing element is initially positioned in abutting contact with and attached to the interior wall surface of the interior panel, i.e. in the spandrel area. It is also possible, that the elastic sealing element is positioned in a cavity or recess located within the spandrel area of the interior panel. By positioning the elastic sealing element in a cavity or recess located within the spandrel area the construction strength is enhanced during a fire due to the additional stabilization of the panel and by avoiding a persistent joint. By using a cavity or recess in a spandrel panel, the elastic sealing element can be designed as a drawer with a sealing area on top and/or bottom allowing using a more rigid material for the sealing element.

According to the present invention, the thermal insulating and sealing means further comprises formwork positioned in abutment with respect to the elastic sealing element and extending across the safing slot toward the edge of the floor. It is preferred that the formwork consists of a semi-rigid material. Preferably, the semi-rigid material is a moisture resistant material, such as a steel plate, an expanded metal sheet, metal grid, fiber-reinforced grid, plastic grid or a thicker foil. In a particular preferred embodiment of the present invention, the formwork is a metal grid enabling the connection of safing slot filling material with the floor. The formwork is preferably initially attached to the elastic sealing element and so positioned to extend across the safing slot toward the edge of the floor within the safing slot.

In a particular preferred embodiment of the present invention, the formwork is pre-installed or pre-fixed to the elastic sealing element. Pre-fixing occurs by attachment means comprising at least one adhesive means, pin means, tongue and groove means, screw means or barbed hook means. The at least one pin or screw means preferably extend through the formwork to either the outer facing surface of the elastic sealing element or to the top surface of the elastic sealing element. Preferably, the attachment means is a self-adhesive tape. However, other attachment devices may be used to attach the formwork to the elastic sealing element according to the present invention. In this embodiment, the formwork comprises two legs formable from one piece of formwork. The first leg is attached to the elastic sealing element and the second leg is formed integrally starting from the lower inner edge of the elastic sealing element reaching towards the lower outer edge of the floor by down-folding in such a way that the second leg is positioned substantially perpendicular to the first leg. Down-folding is preferably performed after installation of the elastic sealing element and the formwork in the spandrel area of the curtain wall structure, i. e. after having installed the façade element. The first leg will not affect the movement capability of the elastic sealing element, as it is attached to the outer surface thereof. The second leg is to be folded down into the safing slot for receiving an insulation means of thermally resistant and/or air tight material. The length of the second leg is longer than the width of the safing slot and hence can act as a formwork as it is jammed in the safing slot.

In an alternative preferred embodiment of the present invention, the formwork is post-installed or post-fixed to the elastic sealing element. Post-fixing occurs by attachment means comprising at least one adhesive means, pin means, tongue and groove means, screw means or barbed hook means. The at least one pin or screw means preferably extend through the formwork to either the outer facing surface of the elastic sealing element or to the top surface of the elastic sealing element. Preferably, the attachment means is a self-adhesive tape. However, other attachment devices may be used to attach the formwork to the elastic sealing element according to the present invention. It is also possible in this embodiment to simply position the formwork within the safing slot without using any attachment means. The elastic sealing element and the formwork provide a flexible connection to the façade element, i.e. the spandrel area, which allows compensation of joint width tolerances and maintains movement capabilities after filling the remaining safing slot with an insulation means of thermally resistant and/or air tight material, in particular with a rigid material such as a mortar. The width of the semi-rigid formwork has to be greater than the joint width. In this case the formwork is pressed against the elastic sealing element and holds in place by friction fit. In order to secure the formwork to the elastic sealing element, support can be guaranteed by a hook or small ledge attached to the interior panel. To enable load, the formwork can have additionally positive connections, such as flanges or hooks, to floor and façade element. It is preferred that a flange which faces the floor is interrupted to allow a direct connection of the safing slot filling material with the floor material. Alternatively the formwork, as well as flanges or hooks can be made from a grid, which enables the connection of the safing slot filling material with the floor material.

The elastic sealing element and the formwork may also be integrally manufactured from the same material or consist of multiple materials and/or parts as described above.

According to the present invention, the thermal insulating and sealing means further comprises an insulation means of thermally resistant and/or air tight material. In particular, the insulation means of thermally resistant and/or air tight material comprises a fire and/or load resistant material, preferably a mortar composition, a fast-curing material, a gypsum material, a mineral wool material, a foam, such for example an elastomeric interlaced foam based on synthetic rubber (Armaflex), or a mineral-based material. In a particular preferred embodiment of the present invention, the thermally resistant and/or air tight material is a gypsum material.

The insulation means of thermally resistant and/or air tight material includes an inner primary end surface positioned in abutment with respect to the outer edge of the floor for sealing thereadjacent, an outer primary end surface positioned in abutment with respect to the elastic sealing element, an lower primary facing surface extending between the inner primary end surface and the outer primary end surface and facing downwardly therebetween positioned in abutting contact with and unattached to the upper facing surface of the formwork. Preferably, the insulation means of thermally resistant and/or air tight material is installed in a last step, after the elastic sealing element and the formwork have been positioned and secured within the safing slot of a curtain wall structure.

According to the present invention, the thermal insulating and sealing means further comprises a supplemental attachment means for attaching of the elastic sealing element with respect to the interior wall surface of the interior panel. It is preferred that the supplemental attachment means comprises at least one adhesive means, pin means, tongue and groove means, screw means or barbed hook means. The at least one pin or screw means preferably extend through the elastic sealing element and is attached to the interior wall surface of the interior panel. Preferably, the supplemental attachment means is a self-adhesive tape. However, other attachment devices may be used to attach the elastic sealing element according to the present invention.

It is particular preferred that the elastic sealing element is attached by the supplemental attachment means to the interior panel at a position within the height of the spatially disposed floor, preferably at a height of the upper facing surface of the insulation means of thermally resistant and/or air tight material.

To further assure maintaining of abutment the elastic sealing element with respect to the interior panel, the elastic sealing element can also be initially installed within a cavity or recess located in the spandrel area. There is no specific means of attachment between the surfaces of the elastic sealing element and walls of the cavity or recess. These surfaces can laterally slide along one another while maintaining abutting contact therebetween. This sliding relative movement would occur responsive to deforming of the interior panel; however additional sealing can enhance maintaining sealing of the safing slot. It should be appreciated that the lateral dimension of the elastic sealing element can be varied significantly to accommodate various configurations of different interior panels and safing slots in order to accommodate and effective thermally insulate and seal any such safing slot.

In order to further maintain a complete seal extending within the safing slot in those conditions where the interior panel has expanded beyond the lateral expansion capability of the elastic sealing element and the insulation means of thermally resistant and/or air tight material, the thermal insulating and sealing means may further comprise an outer fire retardant coating positioned across the elastic sealing element and the insulation means of thermally resistant and/or air tight material and the adjacent portions of the interior wall surface of the interior panel and the floor located thereadjacent. The sealing characteristics of the construction shown in the present invention can be significantly enhanced by the application of such fire retardant coating.

Generally, such outer fire retardant coatings are applied by spraying or other similar means of application. Such outer fire retardant coatings are for example firestop joint sprays, preferably based on water, and self-leveling silicon sealants. Preferably, the outer fire retardant coating has a wet film thickness of at least ⅛ in. Additionally, it is preferable that the outer fire retardant coating overs the top of the elastic sealing element and the insulation means of thermally resistant and/or air tight material, overlapping the outer edge of the floor and the interior face of interior wall surface of the interior panel by a min of ½ in.

One aspect of the present invention provides for a spandrel panel for use in a fire-resistance rated curtain wall construction, which can be installed on site and hence is part of a modular or prefabricated curtain wall design and forms part of the thermal insulating and sealing means.

The spandrel panel according to the present invention, for use in a fire-resistance rated curtain wall construction defined by an interior wall surface including one or more framing members and at least one floor spatially disposed from the interior wall surface of the curtain wall construction, wherein the spandrel panel comprises an exterior wall surface and an interior wall surface, is characterized that the spandrel panel comprises an elastic sealing element comprising a flexible material to facilitate movement between the interior wall surface and the floor; and a formwork positioned in abutment with respect to the elastic sealing element for receiving an insulation means of thermally resistant and/or air tight material.

In particular, the elastic sealing element of the spandrel panel comprises a flexible material to facilitate movement between the interior wall surface and the floor. The elastic sealing element is responsive to thermal deforming movement of the interior panel. Preferably, the flexible material comprises a thermally resistant and/or air tight flexible mineral wool material, rubber-like material or a foam, such for example an elastomeric interlaced foam based on synthetic rubber (Armaflex). In particular, the flexible material may be an open-cell or closed-cell foam-based material, for example a polyurethane-based or silicone-based material. In a particular preferred embodiment of the present invention, the elastic sealing element is a polyurethane-based foam, which can also be intumescent if desired.

The elastic sealing element of the spandrel panel is attached to the interior surface of the spandrel panel or in a cavity or recess located within the spandrel panel. By using a cavity or recess in a spandrel panel, the elastic sealing element can be designed as a drawer with a sealing area on top and/or bottom allowing using a more rigid material for the sealing element. The formwork of the spandrel panel is attached to the elastic sealing element and consists of a semi-rigid material. Preferably, the semi-rigid material is a moisture resistant material, such as a steel plate, an expanded metal sheet, metal grid, fiber-reinforced grid, plastic grid or a thicker foil. In a particular preferred embodiment of the present invention, the formwork is a metal grid enabling the connection of safing slot filling material with the floor.

In a particular preferred embodiment of the spandrel panel, the formwork is pre-installed or pre-fixed to the elastic sealing element. In this embodiment, the formwork comprises two legs formable from one piece of formwork. The first leg is attached to the elastic sealing element and the second leg is formed integrally starting from the lower inner edge of the elastic sealing element reaching towards the lower outer edge of the floor by down-folding in such a way that the second leg is positioned substantially perpendicular to the first leg. Down-folding is performed after installation of the elastic sealing element and the formwork in the spandrel area of the curtain wall structure, i. e. after having installed the façade element. The first leg will not affect the movement capability of the elastic sealing element, as it is attached to the outer surface thereof. The second leg is to be folded down into the safing slot for receiving an insulation means of thermally resistant and/or air tight material. The length of the second leg is longer than the width of the safing slot and hence can act as a formwork as it is jammed in the safing slot. Alternatively, the formwork may consist of one metal grid to be bend within the safing slot in form of an U-shape for receiving the insulation means of thermally resistant and/or air tight material.

Attachment of the formwork occurs by attachment means comprising at least one adhesive means, pin means, tongue and groove means, screw means or barbed hook means. The at least one pin or screw means preferably extend through the formwork to either the outer facing surface of the elastic sealing element or to the top surface of the elastic sealing element. Preferably, the attachment means is a self-adhesive tape. However, other attachment devices may be used to attach the formwork to the elastic sealing element according to the present invention.

The elastic sealing element and the formwork may also be integrally manufactured from the same material or consist of multiple materials and/or parts as described above.

The thermal insulating and sealing means according to the present invention is preferably for use with a building construction having a wall construction defining an interior wall surface, which includes an interior panel extending over the interior surface thereof and at least one floor spatially disposed from the inner wall surface defining a safing slot extending between the interior wall surface of the interior panel and an outer edge of the floor.

In particular, the building construction comprises a thermal insulating and sealing means for effectively thermally insulating and sealing of the safing slot, wherein the thermal insulating and sealing means comprises:

i) an elastic sealing element positioned in the safing slot and in abutment with respect to the interior wall surface of the interior panel;

ii) a formwork positioned in abutment with respect to the elastic sealing element and extending across the safing slot toward the edge of the floor;

iii) an insulation means of thermally resistant and/or air tight material in abutment with respect to an upper surface of the formwork and extending across the safing slot toward the outer edge of the floor thereadjacent;

and iv) a supplemental attachment means for attaching of the elastic sealing element with respect to the interior wall surface of the interior panel, wherein the elastic sealing element comprises a thermally resistant and/or air tight flexible mineral wool material, rubber-like material or a foam and is initially positioned in abutting contact with and attached to the interior wall surface of the interior panel or in a cavity or recess located within the spandrel area of the interior panel;

the formwork consists of a semi-rigid material, preferably a steel plate, an expanded metal sheet, metal grid, fiber-reinforced grid, plastic grid or a thicker foil and is initially attached to the elastic sealing element and so positioned to extend across the safing slot toward the edge of the floor;

the insulation means of thermally resistant and/or air tight material comprises a fire and/or load resistant material, preferably a mortar composition, a gypsum material, a mineral wool material, a foam or a mineral-based material and is positioned in abutting contact with and unattached to the upper facing surface of the formwork and extends across the safing slot toward the outer edge of the floor; and the supplemental attachment means comprises at least one adhesive means, pin means, tongue and groove means, screw means or barbed hook means and attach the formwork to either the outer facing surface of the elastic sealing element or to the top surface of the elastic sealing element.

The thermal insulating and sealing means as well as the spandrel panel according to the present invention is also suitable for acoustically insulating and sealing of a safing slot of a curtain wall structure. The insulation means may be of a sound resistant and/or air tight material and the elastic sealing element may comprises an acoustically resistant and/or air tight material.

While the invention is particularly pointed out and distinctly described herein, a preferred embodiment is set forth in the following detailed description which may be best understood when read in connection with the accompanying drawings.

In FIG. 1 is shown a side cross-sectional view of an embodiment of the thermal/acoustic insulating and sealing means between the outer edge of a floor and the interior wall surface of the interior panel when installed and attached to a steel back pan. In particular, FIG. 1 shows an embodiment of the thermal insulating and sealing means of the present invention for effectively thermally insulating and sealing of a safing slot 1 within a building construction having a wall construction 2 defining an interior wall surface 3, which includes an interior steel panel 4 extending over the interior surface thereof and at least one floor 5 spatially disposed from the inner wall surface 3 defining the safing slot 1 extending between the interior wall surface 3 of the interior panel 4 and an outer edge 6 of the concrete floor 5. The thermal insulating and sealing means comprises an elastic sealing element 7 of thermally resistant and air tight flexible material, such as a polyurethane-based foam, positioned in abutting contact with and attached using a supplemental attachment means, preferably an adhesive material, to the interior wall surface 3 of the interior panel 4. The thermal insulating and sealing means comprises further a formwork 8 positioned in abutment with respect to the elastic sealing 7 element and extending across the safing slot 1 toward the edge 6 of the floor 5. The formwork 8 is a semi-rigid metal grid for receiving the insulation means of thermally resistant and air tight material 10, such a gypsum material or the like. The insulation means of thermally resistant and air tight material 10 is positioned in abutting contact with and unattached to the upper facing surface of the formwork 8 and extends across the safing slot 1 toward the outer edge of the floor. The insulation means of thermally resistant and air tight material 10 includes an inner primary end surface positioned in abutment with respect to the outer edge 6 of the floor 5 for sealing thereadjacent, an outer primary end surface positioned in abutment with respect to the elastic sealing element 7, an lower primary facing surface extending between the inner primary end surface and the outer primary end surface and facing downwardly therebetween positioned in abutting contact with and unattached to the upper facing surface of the formwork 8. Not shown in FIG. 1 is that an outer fire retardant coating may be positioned across the elastic sealing element 7 and the insulation means of thermally resistant and/or air tight material 10 and the adjacent portions of the interior wall surface 3 of the interior panel 4 and the floor 5 located thereadjacent in order to further maintain a complete seal extending within the safing slot 1 in those conditions where the interior panel 4 has expanded beyond the lateral expansion capability of the elastic sealing element 7 and the insulation means of thermally resistant and/or air tight material 10. Not shown in FIG. 1 is the attachment means for attaching the formwork 8 to the elastic sealing element 7.

Figure 2:
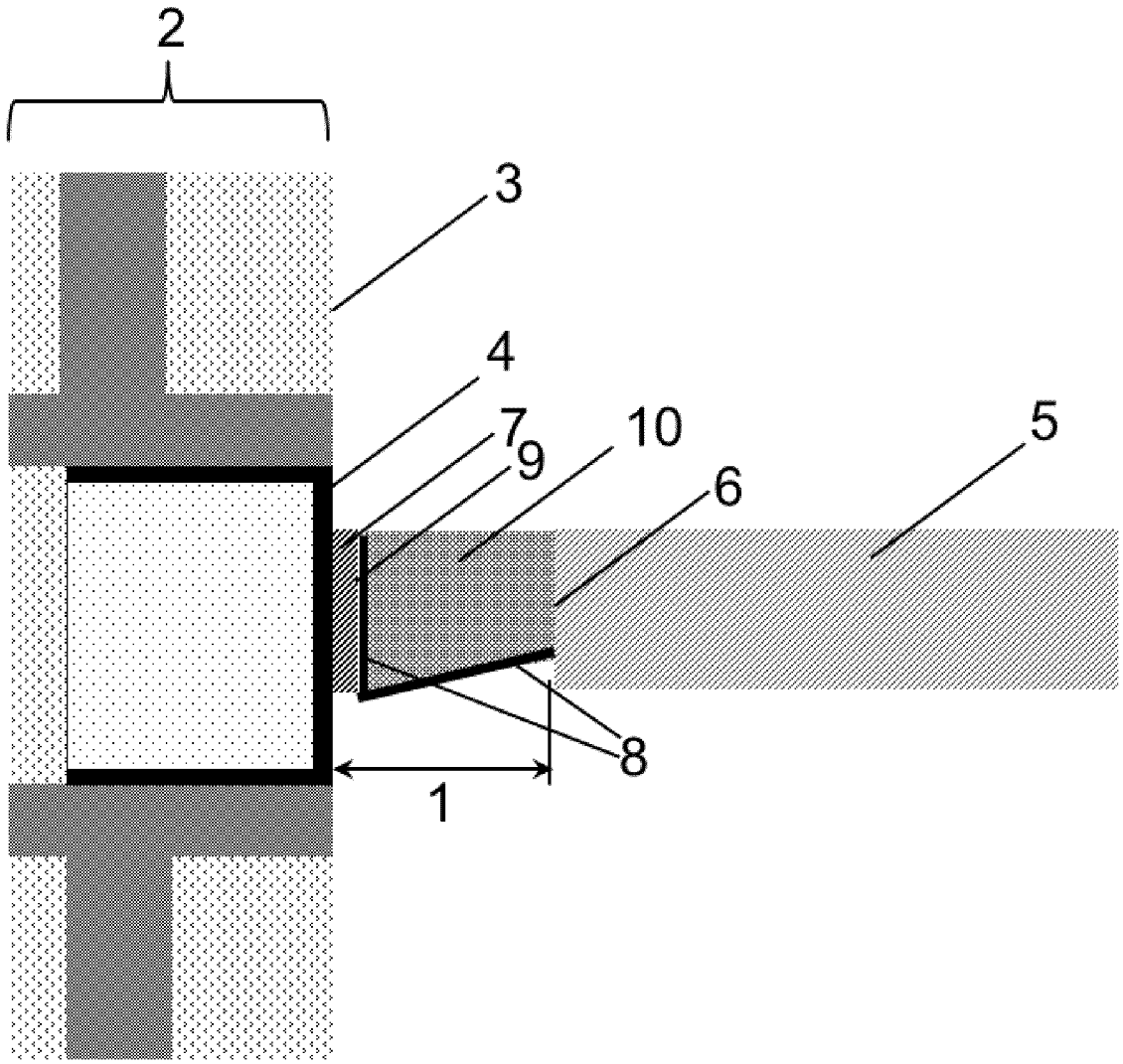
FIG. 2 shows a side cross-sectional view of another embodiment of the thermal/acoustic insulating and sealing means between the outer edge of a floor and the interior wall surface of the interior panel when installed and attached to a steel back pan.

In FIG. 2 is shown a side cross-sectional view of another embodiment of the thermal/acoustic insulating and sealing means between the outer edge of a floor and the interior wall surface of the interior panel when installed and attached to a steel back pan. The thermal insulating and sealing means comprises an elastic sealing element 7 of thermally resistant and air tight flexible material, such as a polyurethane-based foam, positioned in abutting contact with and attached using a supplemental attachment means, preferably an adhesive material, to the interior wall surface 3 of the interior panel 4. The thermal insulating and sealing means comprises further a formwork 8 positioned in abutment with respect to the elastic sealing 7 element and extending across the safing slot 1 toward the edge 6 of the floor 5. The formwork 8 is a semi-rigid metal grid for receiving the insulation means of thermally resistant and air tight material 10, such a gypsum material or the like. In this embodiment the formwork 8 comprises two legs formable from one piece of formwork 8. The first leg is attached to the outer surface 9 of the elastic sealing element 7 and the second leg is formed integrally starting from the lower inner edge of the elastic sealing element 7 reaching towards the lower outer edge of the floor 5 by down-folding in such a way that the second leg is positioned substantially perpendicular to the first leg. The insulation means of thermally resistant and air tight material 10 is positioned in abutting contact with and unattached to the upper facing surface of the formwork 8 and extends across the safing slot 1 toward the outer edge of the floor. The insulation means of thermally resistant and air tight material 10 includes an inner primary end surface positioned in abutment with respect to the outer edge 6 of the floor 5 for sealing thereadjacent, an outer primary end surface positioned in abutment with respect to the elastic sealing element 7, a lower primary facing surface extending between the inner primary end surface and the outer primary end surface and facing downwardly therebetween positioned in abutting contact with and unattached to the upper facing surface of the formwork 8. Not shown in FIG. 2 is that an outer fire retardant coating may be positioned across the elastic sealing element 7 and the insulation means of thermally resistant and/or air tight material 10 and the adjacent portions of the interior wall surface 3 of the interior panel 4 and the floor 5 located thereadjacent in order to further maintain a complete seal extending within the safing slot 1 in those conditions where the interior panel 4 has expanded beyond the lateral expansion capability of the elastic sealing element 7 and the insulation means of thermally resistant and/or air tight material 10. Not shown in FIG. 2 is the attachment means for attaching the formwork 8 to the elastic sealing element 7.

Figure 3:
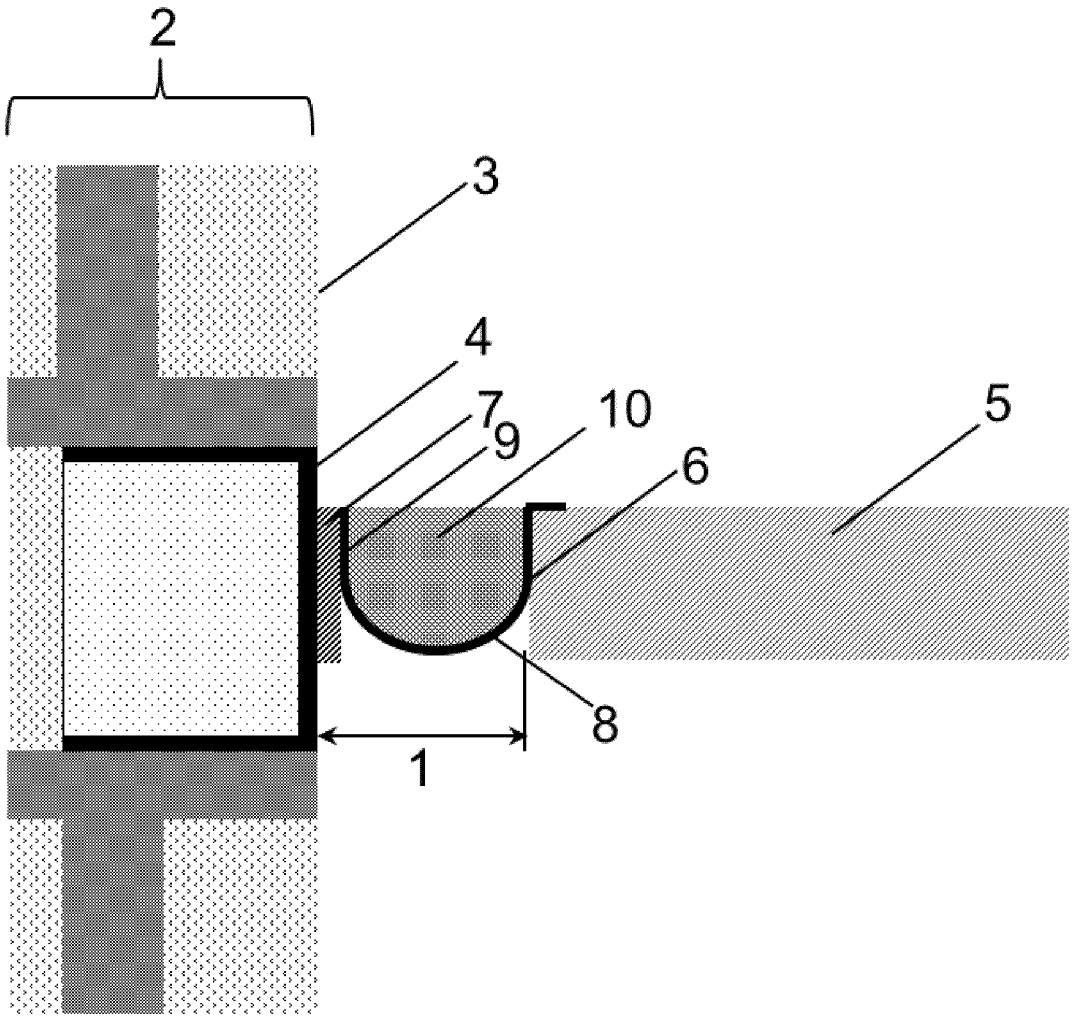
FIG. 3 shows a side cross-sectional view of another embodiment of the thermal/acoustic insulating and sealing means between the outer edge of a floor and the interior wall surface of the interior panel when installed and attached to a steel back pan.

In FIG. 3 is shown a side cross-sectional view of another embodiment of the thermal/acoustic insulating and sealing means, similar to the embodiment shown in FIG. 2, between the outer edge of a floor and the interior wall surface of the interior panel when installed and attached to a steel back pan. The formwork 8 consist of one metal grid to be bend within the safing slot in form of an U-shape for receiving the insulation means of thermally resistant and/or air tight material 10. Not shown in FIG. 3 is the attachment means for attaching the formwork 8 to the elastic sealing element 7 as well as to the top of the floor.

Figure 4:
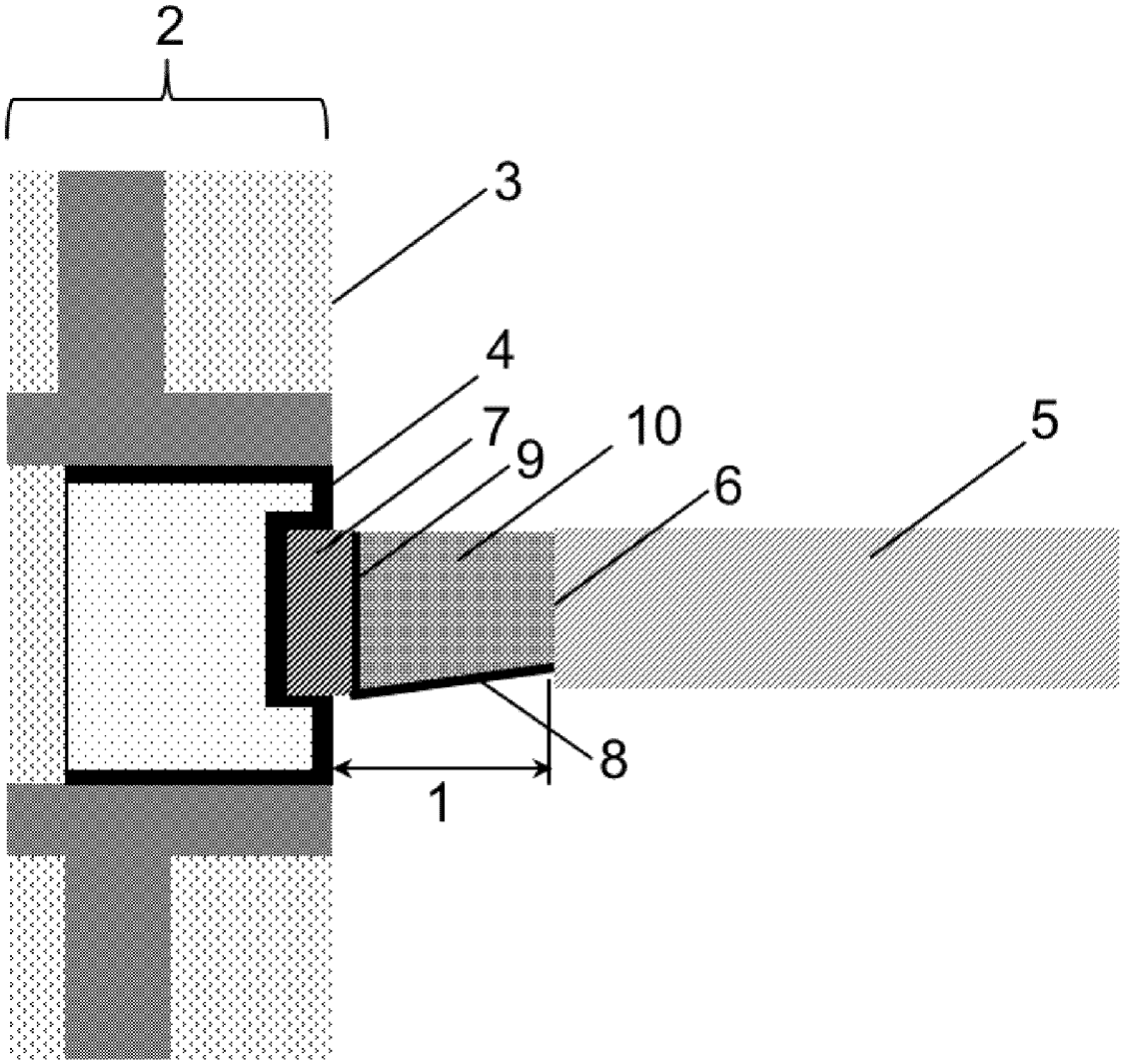
FIG. 4 shows a side cross-sectional view of an embodiment of the thermal/acoustic insulating and sealing means between the outer edge of a floor and the interior wall surface of the interior panel when installed in a cavity or recess of a steel back pan.

In FIG. 4 is shown a side cross-sectional view of another embodiment of the thermal/acoustic insulating and sealing means between the outer edge of a floor and the interior wall surface of the interior panel when installed in a cavity or recess of a steel back pan. The elastic sealing element 7 is positioned within a cavity or recess located in the spandrel panel. The formwork 8 comprises two legs formable from one piece of formwork 8. The first leg is attached to the outer surface 9 of the elastic sealing element 7 and the second leg is formed integrally starting from the lower inner edge of the elastic sealing element 7 reaching towards the lower outer edge of the floor 5 by down-folding in such a way that the second leg is positioned substantially perpendicular to the first leg, similar to the embodiment as shown in FIG. 2. Not shown in FIG. 4 is the attachment means for attaching the formwork 8 to the elastic sealing element 7.

Figure 5:
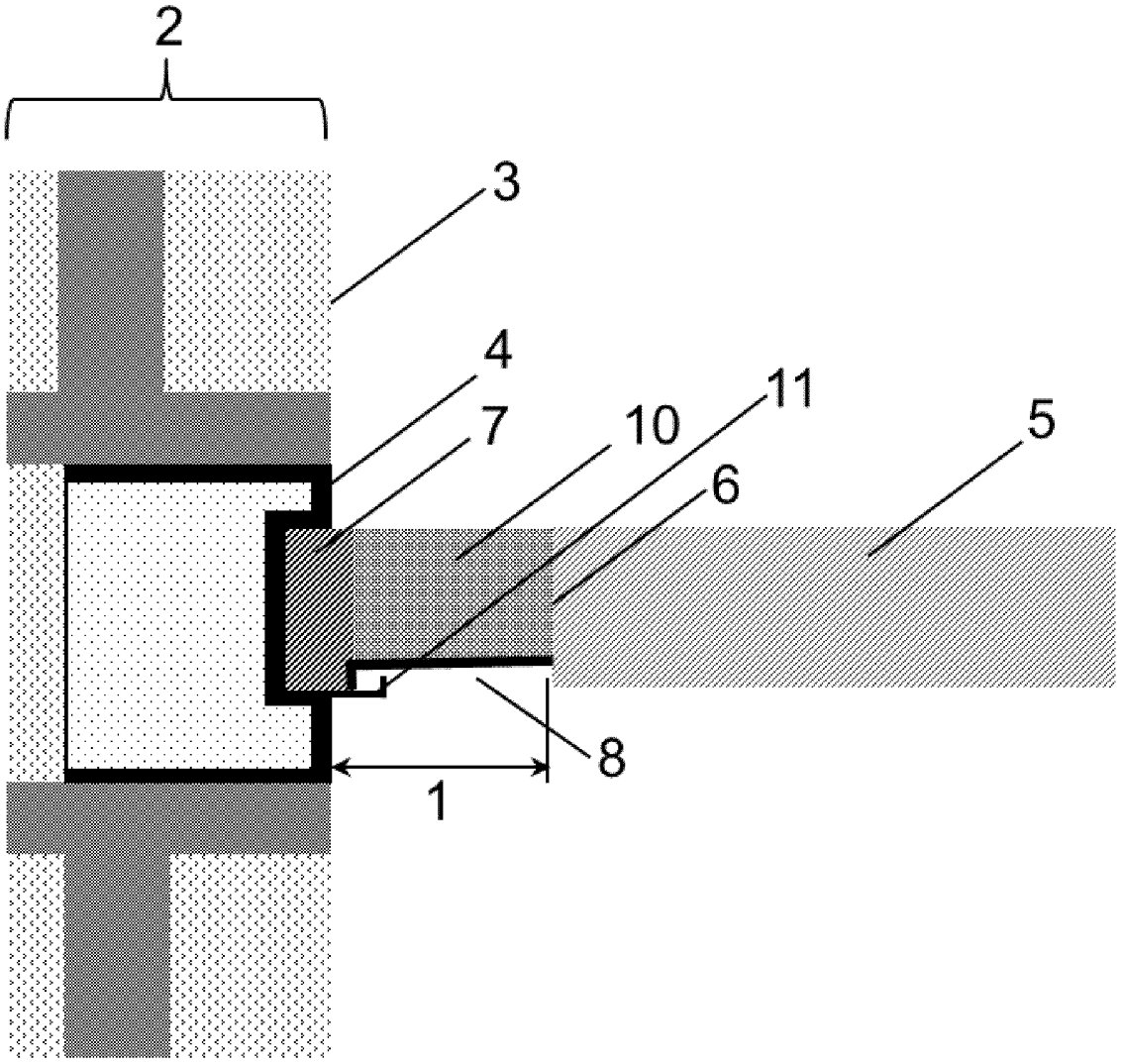
FIG. 5 shows a side cross-sectional view of another embodiment of the thermal/acoustic insulating and sealing means between the outer edge of a floor and the interior wall surface of the interior panel when installed in a cavity or recess of a steel back pan.

In FIG. 5 is shown a side cross-sectional view of another embodiment of the thermal/acoustic insulating and sealing means between the outer edge of a floor and the interior wall surface of the interior panel when installed in a cavity or recess of a steel back pan. In this embodiment the formwork 8 is post-installed to the elastic sealing element 7. In this case the formwork 8 is pressed against the elastic sealing element 7 and holds in place by friction fit. In order to secure the formwork 8 to the elastic sealing element 7, support is guaranteed by a hook 11 or small ledge 11 attached to the interior panel 4. Not shown in FIG. 5 is the attachment means for attaching the formwork 8 to the elastic sealing element 7.

Figure 6:
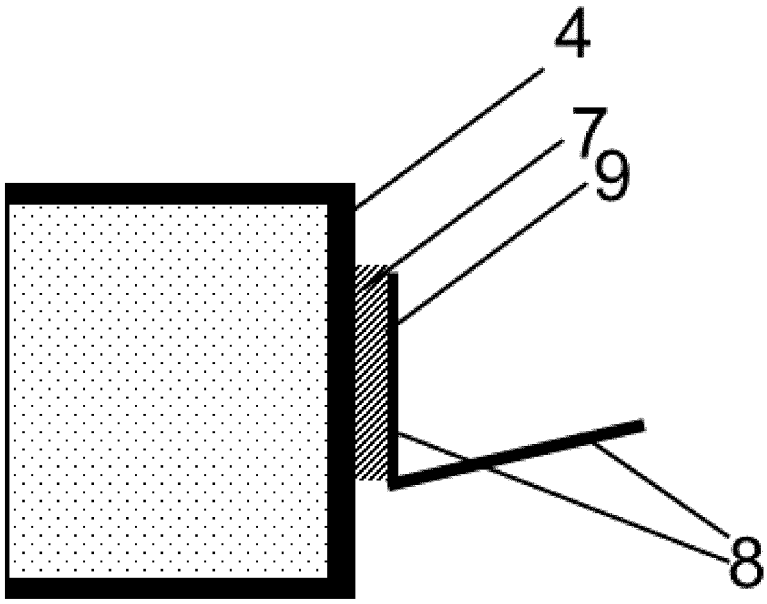
FIG. 6 shows a side cross-sectional view of an embodiment of a spandrel panel comprising an elastic sealing element and a formwork.

In FIG. 6 is shown a side cross-sectional view of an embodiment of a spandrel panel comprising an elastic sealing element 7 and a formwork 8. The formwork comprises two legs formable from one piece of formwork 8. The first leg is attached to the outer surface 9 of the elastic sealing element and the second leg is formed integrally starting from the lower inner edge of the elastic sealing element for reaching towards the lower outer edge of the floor by down-folding in such a way that the second leg is to be positioned substantially perpendicular to the first leg. Not shown in FIG. 6 is that the formwork may consist of one metal grid to be bend within the safing slot in form of an U-shape for receiving the insulation means of thermally resistant and/or air tight material. Not shown in FIG. 6 is the attachment means for attaching the formwork 8 to the elastic sealing element 7.

It should be appreciate that these embodiments of the present invention will work with many different types of insulating materials used for the insulation means of thermally resistant and/or air tight material, with many different types and shapes of the formwork, with many different types and shapes of the elastic sealing element means as well as with many different types of attachment means as long as the material is suitable for maintaining the seal of the safing slot.

It has been shown, that the thermal insulating and sealing means for sealing between the edge of a floor and an interior panel of the present invention maintains sealing of the safing slots surrounding the floor of each level in a building despite deforming of the interior panels especially those back pans made of various materials such as metal or the like which are positioned extending across the interior expanse of the curtain walls.

Furthermore, the thermal insulating and sealing means effectively create a continuous fireproofing seal extending from the outermost edge of the floor to the curtain wall structure and, in particular, to abutment with or even within a cavity or recess in the interior panel extending across the curtain wall surface.

It has been shown that the thermal insulation and sealing means according to the present invention is easily installable from the top, i.e. a one-sided application.

Further, the thermal insulating and sealing means is not limited to a specific joint width or spandrel height; on face installation on the transom is possible and there is no limitation of vertical movement capacities of the joint system. The thermal insulating and sealing means provide a clear separation of movement and tolerance compensation as well as reduction of the final movement joint width to a minimum which leads to improved fire resistance. The tolerance joint can be closed with rigid material which creates load bearing properties. It has been shown that the thermal insulating and sealing means are able to compensate dimensional tolerances of the concreted floor and to allow movement between the floor and the façade element caused by load, temperature or wind load.

Moreover, the spandrel panel can be installed on site and hence is part of a modular or prefabricated curtain wall design. It can be integrated in the façade assembly providing an increase of installation efficiency, thereby reduce installation failures.

As such, the thermal insulating and sealing means of the present invention provides a means for effectively maintaining a complete seal in a safing slot when utilizing modular curtain wall constructions which include interior panels extending across the interior surface thereof as is commonly utilized currently for modular or prefabricated designs.

Finally, it has been shown, that the thermal insulating and sealing means is also suitable for acoustically insulating and sealing of a safing slot of a curtain wall structure.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

Further embodiments refer to the following items:

1. A thermal insulating and sealing means for effectively thermally insulating and sealing of a safing slot within a building construction having a wall construction defining an interior wall surface, which includes an interior panel extending over the interior surface thereof and at least one floor spatially disposed from the inner wall surface defining the safing slot extending between the interior wall surface of the interior panel and an outer edge of the floor, comprising:
   i) an elastic sealing element positioned in the safing slot and in abutment with respect to the interior wall surface of the interior panel;
   ii) a formwork positioned in abutment with respect to the elastic sealing element and extending across the safing slot toward the edge of the floor;
   iii) an insulation means of thermally resistant and/or air tight material in abutment with respect to an upper surface of the formwork and extending across the safing slot toward the outer edge of the floor thereadjacent;
   and
   iv) a supplemental attachment means for attaching of the elastic sealing element with respect to the interior wall surface of the interior panel.
2. Thermal insulating and sealing means according to item 1, wherein the elastic sealing element comprises a flexible material to facilitate movement between the interior wall surface and the floor.
3. Thermal insulating and sealing means according to item 2, wherein the flexible material comprises a thermally resistant and/or air tight flexible mineral wool material, rubber-like material or a foam.
4. Thermal insulating and sealing means according to item 1, wherein the formwork consists of a semi-rigid material.
5. Thermal insulating and sealing means according to item 4, wherein the semi-rigid material is a moisture resistant material, preferably a steel plate, an expanded metal sheet, metal grid, fiber-reinforced grid, plastic grid or a thicker foil.
6. Thermal insulating and sealing means according to item 1, wherein the insulation means of thermally resistant and/or air tight material comprises a fire and/or load resistant material.
7. Thermal insulating and sealing means according to item 6, wherein the fire and/or load resistant material is a mortar composition, a gypsum material, a mineral wool material, a foam or a mineral-based material.
8. Thermal insulating and sealing means according to item 1, wherein the elastic sealing element is initially positioned in abutting contact with and attached to the interior wall surface of the interior panel or in a cavity or recess located within the spandrel area of the interior panel.

9. Thermal insulating and sealing means according to item 1, wherein the formwork is initially attached to the elastic sealing element and so positioned to extend across the safing slot toward the edge of the floor.

10. Thermal insulating and sealing means according to item 1, wherein the insulation means of thermally resistant and/or air tight material is positioned in abutting contact with and unattached to the upper facing surface of the formwork and extends across the safing slot toward the outer edge of the floor.

11. Thermal insulating and sealing means according to item 1, wherein the supplemental attachment means comprises at least one adhesive means, pin means, tongue and groove means, screw means or barbed hook means.

12. Thermal insulating and sealing means according to item 9, wherein the formwork comprises two legs formable from one piece of formwork.

13. Thermal insulating and sealing means according to item 10, wherein a first leg of the two legs is attached to the elastic sealing element and a second leg of the two legs is formed integrally starting from a lower inner edge of the elastic sealing element reaching towards the lower outer edge of the floor by down-folding in such a way that the second leg is positioned substantially perpendicular to the first leg.

14. A spandrel panel for use in a fire-resistance rated curtain wall construction defined by an interior wall surface including one or more framing members and at least one floor spatially disposed from the interior wall surface of the curtain wall construction, wherein the spandrel panel comprises an exterior wall surface and an interior wall surface, characterized that the spandrel panel comprises i) an elastic sealing element comprising a flexible material to facilitate movement between the interior wall surface and the floor; and ii) a formwork positioned in abutment with respect to the elastic sealing element for receiving an insulation means of thermally resistant and/or air tight material.

15. Spandrel panel for use according to item 14, wherein the elastic sealing element comprises a flexible material to facilitate movement between the interior wall surface and the floor.

16. Spandrel panel for use according to item 15, wherein the flexible material comprises a thermally resistant and/or air tight flexible mineral wool material, rubber-like material or a foam.

17. Spandrel panel for use according to item 14, wherein the formwork consists of a semi-rigid material.

18. Spandrel panel for use according to item 17, wherein the semi-rigid material is a moisture resistant material, preferably a steel plate, an expanded metal sheet, metal grid, fiber-reinforced grid, plastic grid or a thicker foil.

19. Spandrel panel for use according to item 14, wherein the elastic sealing element is positioned in abutting contact with and attached to the interior wall surface of the spandrel panel or in a cavity or recess located within the spandrel panel.

20. A building construction having a wall construction defining an interior wall surface, which includes an interior panel extending over the interior surface thereof and at least one floor spatially disposed from the inner wall surface defining a safing slot extending between the interior wall surface of the interior panel and an outer edge of the floor, comprising a thermal insulating and sealing means for effectively thermally insulating and sealing of the safing slot, wherein the thermal insulating and sealing means comprises i) an elastic sealing element positioned in the safing slot and in abutment with respect to the interior wall surface of the interior panel;

ii) a formwork positioned in abutment with respect to the elastic sealing element and extending across the safing slot toward the edge of the floor;

iii) an insulation means of thermally resistant and/or air tight material in abutment with respect to an upper surface of the formwork and extending across the safing slot toward the outer edge of the floor thereadjacent;

and iv) a supplemental attachment means for attaching of the elastic sealing element with respect to the interior wall surface of the interior panel, wherein the elastic sealing element comprises a thermally resistant and/or air tight flexible mineral wool material, rubber-like material or a foam and is initially positioned in abutting contact with and attached to the interior wall surface of the interior panel or in a cavity or recess located within the spandrel area of the interior panel;

the formwork consists of a semi-rigid material, preferably a steel plate, an expanded metal sheet, metal grid, fiber-reinforced grid, plastic grid or a thicker foil and is initially attached to the elastic sealing element and so positioned to extend across the safing slot toward the edge of the floor;

the insulation means of thermally resistant and/or air tight material comprises a fire and/or load resistant material, preferably a mortar composition, a gypsum material, a mineral wool material, a foam or a mineral-based material and is positioned in abutting contact with and unattached to the upper facing surface of the formwork and extends across the safing slot toward the outer edge of the floor; and the supplemental attachment means comprises at least one adhesive means, pin means, tongue and groove means, screw means or barbed hook means and attach the formwork to either the outer facing surface of the elastic sealing element or to the top surface of the elastic sealing element.

21. A building construction having a wall construction defining an interior wall surface, which includes an interior panel extending over the interior surface thereof and at least one floor spatially disposed from the inner wall surface defining a safing slot extending between the interior wall surface of the interior panel and an outer edge of the floor, comprising a thermal insulating and sealing means for effectively thermally insulating and sealing of the safing slot, wherein the thermal insulating and sealing means comprises the spandrel panel according to any one of the items 14 to 19.

22. An acoustic insulating and sealing means for effectively acoustically insulating and sealing of a safing slot within a building construction having a wall construction defining an interior wall surface, which includes an interior panel extending over the interior surface thereof and at least one floor spatially disposed from the inner wall surface defining the safing slot extending between the interior wall surface of the interior panel and an outer edge of the floor, comprising:

i) an elastic sealing element positioned in the safing slot and in abutment with respect to the interior wall surface of the interior panel;

ii) a formwork positioned in abutment with respect to the elastic sealing element and extending across the safing slot toward the edge of the floor;

iii) an insulation means of sound resistant and/or air tight material in abutment with respect to an upper surface of the formwork and extending across the safing slot toward the outer edge of the floor thereadjacent;

and iv) a supplemental attachment means for attaching of the elastic sealing element with respect to the interior wall surface of the interior panel.

23. Acoustic insulating and sealing means according to item 22, wherein the elastic sealing element comprises a flexible material to facilitate movement between the interior wall surface and the floor.

24. Acoustic insulating and sealing means according to item 23, wherein the flexible material comprises a sound resistant and/or air tight flexible mineral wool material, rubber-like material or a foam.

25. Acoustic insulating and sealing means according to item 22, wherein the formwork consists of a semi-rigid material.

26. Acoustic insulating and sealing means according to item 25, wherein the semi-rigid material is a moisture resistant material, preferably a steel plate, an expanded metal sheet, metal grid, fiber-reinforced grid, plastic grid or a thicker foil.

27. Acoustic insulating and sealing means according to item 22, wherein the insulation means of sound resistant and/or air tight material comprises a sound and/or load resistant material.

28. Acoustic insulating and sealing means according to item 27, wherein the sound and/or load resistant material is a mortar composition, a gypsum material, a mineral wool material, a foam or a mineral-based material.

29. Acoustic insulating and sealing means according to item 22, wherein the elastic sealing element is initially positioned in abutting contact with and attached to the interior wall surface of the interior panel or in a cavity or recess located within the spandrel area of the interior panel.

30. Acoustic insulating and sealing means according to item 22, wherein the formwork is initially attached to the elastic sealing element and so positioned to extend across the safing slot toward the edge of the floor.

31. Acoustic insulating and sealing means according to item 22, wherein the insulation means of sound resistant and/or air tight material is positioned in abutting contact with and unattached to the upper facing surface of the formwork and extends across the safing slot toward the outer edge of the floor.

32. Acoustic insulating and sealing means according to item 22, wherein the supplemental attachment means comprises at least one adhesive means, pin means, tongue and groove means, screw means or barbed hook means.

33. Acoustic insulating and sealing means according to item 30, wherein the formwork comprises two legs formable from one piece of formwork.

34. Acoustic insulating and sealing means according to item 31, wherein a first leg of the two legs is attached to the elastic sealing element and a second leg of the two legs is formed integrally starting from a lower inner edge of the elastic sealing element reaching towards the lower outer edge of the floor by down-folding in such a way that the second leg is positioned substantially perpendicular to the first leg.

35. A building construction having a wall construction defining an interior wall surface, which includes an interior panel extending over the interior surface thereof and at least one floor spatially disposed from the inner wall surface defining a safing slot extending between the interior wall surface of the interior panel and an outer edge of the floor, comprising an acoustic insulating and sealing means for effectively thermally insulating and sealing of the safing slot, wherein the acoustic insulating and sealing means comprises i) an elastic sealing element positioned in the safing slot and in abutment with respect to the interior wall surface of the interior panel;

ii) a formwork positioned in abutment with respect to the elastic sealing element and extending across the safing slot toward the edge of the floor;

iii) an insulation means of sound resistant and/or air tight material in abutment with respect to an upper surface of the formwork and extending across the safing slot toward the outer edge of the floor thereadjacent;

and iv) a supplemental attachment means for attaching of the elastic sealing element with respect to the interior wall surface of the interior panel, wherein the elastic sealing element comprises a sound resistant and/or air tight flexible mineral wool material, rubber-like material or a foam and is initially positioned in abutting contact with and attached to the interior wall surface of the interior panel or in a cavity or recess located within the spandrel area of the interior panel;

the formwork consists of a semi-rigid material, preferably a steel plate, an expanded metal sheet, metal grid, fiber-reinforced grid, plastic grid or a thicker foil and is initially attached to the elastic sealing element and so positioned to extend across the safing slot toward the edge of the floor;

the insulation means of sound resistant and/or air tight material comprises a sound and/or load resistant material, preferably a mortar composition, a gypsum material, a mineral wool material, a foam or a mineral-based material and is positioned in abutting contact with and unattached to the upper facing surface of the formwork and extends across the safing slot toward the outer edge of the floor; and the supplemental attachment means comprises at least one adhesive means, pin means, tongue and groove means, screw means or barbed hook means and attach the formwork to either the outer facing surface of the elastic sealing element or to the top surface of the elastic sealing element.

36. A building construction having a wall construction defining an interior wall surface, which includes an interior panel extending over the interior surface thereof and at least one floor spatially disposed from the inner wall surface defining a safing slot extending between the interior wall surface of the interior panel and an outer edge of the floor, comprising an acoustic insulating and sealing means for effectively acoustically insulating and sealing of the safing slot, wherein the acoustic insulating and sealing means comprises the spandrel panel according to any one of the items 14 to 19.

The invention claimed is:

1. A thermal insulating and sealant element for effectively thermally insulating and sealing of a safing slot within a building construction having a wall construction defining an interior wall surface, which comprises an interior panel extending over the interior surface thereof and at least one floor spatially disposed from the inner wall surface defining the safing slot extending between the interior wall surface of the interior panel and an outer edge of the floor, the insulating and sealant element comprising:

(i) an elastic sealing element configured to be positioned in the safing slot and abutting the interior wall surface of the interior panel;

(ii) a formwork configured to abut the elastic sealing element, the formwork comprising a first surface parallel and coupled to the elastic sealing element and a second surface coupled to the first surface and configured to extend across the safing slot toward the edge of the floor;

(iii) an insulating element, which comprises a thermally resistant and/or air tight material, the insulating element configured to abut the first surface and the second surface of the formwork with the second surface configured to extend across the safing slot toward the outer edge of the floor thereadjacent and in an area of the safing slot between the elastic sealing element and the outer edge of the floor, at least a portion of the second surface oriented at an acute angle relative to the elastic sealing element and a combined length of the first surface and the second surface of the formwork that is in the safing slot exceeding a width of the area of the safing slot; and (iv) a supplemental attachment apparatus for attaching the elastic sealing element to the interior wall surface of the interior panel, wherein the formwork supports the insulating element without penetrating the insulating element, and wherein the insulating element comprises one layer of the thermally resistant and/or air tight material extending only from the second surface of the formwork to a plane of an upper surface of the floor.

2. The thermal insulating and sealant element according to claim 1, wherein the elastic sealing element comprises a flexible material to facilitate movement between the interior wall surface and the floor.

3. The thermal insulating and sealant element according to claim 2, wherein the flexible material comprises flexible mineral wool material, rubber-like material, or a foam, wherein the flexible material is thermally resistant, air tight, or both thermally resistant and air tight.

4. The thermal insulating and sealant element according to claim 1, wherein the formwork comprises a semi-rigid material.

5. The thermal insulating and sealant element according to claim 4, wherein the semi-rigid material is at least one material selected from the group consisting of a moisture resistant material, an expanded metal sheet, metal grid, fiber-reinforced grid, plastic grid, and a thicker foil.

6. The thermal insulating and sealant element according to claim 1, wherein the insulating element comprises a fire and/or load resistant material.

7. The thermal insulating and sealant element according to claim 6, wherein the fire and/or load resistant material is at least one material selected from the group consisting of a mortar composition, a gypsum material, a mineral wool material, a foam, and a mineral-based material.

8. The thermal insulating and sealant element according to claim 1, wherein the second surface of the formwork is curved in a concave direction and has a first end coupled to the elastic sealing element that is in abutting contact with and attached to the interior wall surface of the interior panel and a second end coupled to the at least one floor.

9. The thermal insulating and sealant element according to claim 1, wherein the insulating element is configured to be positioned in abutting contact with and unattached to at least one of the first surface and the second surface of the formwork and extends across the sating slot toward the outer edge of the floor.

10. The thermal insulating and sealant element according to claim 1, wherein the supplemental attachment apparatus comprises at least one member selected from the group consisting of an adhesive, a pin, a tongue, a groove, a screw, and a barbed hook.

11. A method of acoustically insulating and sealing a safing slot, the method comprising:

applying the thermal insulating element and sealant element according to claim 1 to a sating slot, wherein the safing slot is within a building construction having a wall construction defining an interior wall surface, which comprises an interior panel extending over the interior surface thereof and at least one floor spatially disposed from the inner wall surface defining the safing slot extending between the interior wall surface of the interior panel and an outer edge of a floor.

12. The thermal insulating and sealant element of claim 1, wherein the insulating element comprises an air tight material.

13. A spandrel panel for use in a tire-resistance rated curtain wall construction, wherein the spandrel panel comprises:

an exterior wall surface, an interior wall surface, an elastic sealing element comprising a flexible material to facilitate movement between the interior wall surface and a floor; and a formwork positioned in abutment with respect to the elastic sealing element fix receiving an insulating element that comprises a thermally resistant and/or air tight material, the formwork in a safing slot between the elastic sealing element and the floor and comprising a first surface parallel and coupled to the elastic sealing element and a second surface coupled to the first surface, at least a portion of the second surface oriented at an acute angle relative to the elastic sealing element and a combined length of the first surface and the second surface of the formwork that is in the sating slot exceeding a width of the area of the safing slot, wherein the formwork supports the insulating element without penetrating the insulating element, wherein the fire-resistance rated curtain wall construction is defined by an interior wall surface comprising one or more framing members and at least one floor spatially disposed from the interior wall surface of the curtain wall construction, wherein the elastic sealing element is positioned in abutting contact with and attached to a cavity or recess located within the spandrel panel, and wherein the insulating element comprises one layer of the thermally resistant and/or air tight material extending only from the second surface of the formwork to a plane of an upper surface of the floor.

14. The spandrel panel according to claim 13, wherein the formwork comprises at least one member selected from the group consisting of a semi-rigid material, an expanded metal sheet, metal grid, fiber-reinforced grid, plastic grid, and a thicker foil.

15. A building construction having a wall construction defining an interior wall surface, which comprises an interior panel extending over the interior surface thereof and at least one floor spatially disposed from the inner wall surface defining a sating slot extending between the interior wall surface of the interior panel and an outer edge of the floor, comprising a thermal insulating and sealant element for effectively thermally insulating and sealing of the safing slot, wherein the thermal insulating and sealant element comprises the spandrel panel according to claim 13.

16. The spandrel panel of claim 13, wherein the insulating element comprises an air tight material.

17. A sealing apparatus, comprising:

elastic material configured to be positioned in a sating slot between a wall and an edge of a floor;

insulating material configured to be arranged adjacent the wall in the sating slot; and a formwork configured to be in an area of the sating slot between the insulting material and the elastic material; the insulating material supported by an upper surface of the formwork; wherein the formwork comprises a first surface parallel and coupled to the elastic material and a second surface coupled to the first surface and configured to extend across the sating slot toward the edge of the floor, wherein at least a portion of the second surface is oriented at an acute angle relative to the elastic material and wherein a combined length of the first surface and the second surface of the framework that is in the safing slot exceeds a width of the area of the sating slot, wherein the formwork supports the insulating material without penetrating the insulating material, and wherein the insulating material comprises one layer of the thermally resistant and/or air tight material extending only from the second surface of the formwork to a plane of an upper surface of the floor.

18. The sealing apparatus according to claim 17, wherein the elastic material is configured to be disposed in a recess or cavity of the wall.

19. The sealing apparatus of claim 17, wherein the insulating material comprises an air tight material.

* * * * *